US007267583B1

(12) United States Patent
Smith

(10) Patent No.: US 7,267,583 B1
(45) Date of Patent: Sep. 11, 2007

(54) ELECTRICAL CONNECTION SYSTEM

(75) Inventor: Mark W. Smith, El Paso, TX (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/523,282

(22) Filed: Sep. 19, 2006

(51) Int. Cl.
*H01R 24/00* (2006.01)

(52) U.S. Cl. ..... 439/660; 439/885; 439/924.1

(58) Field of Classification Search ..... 439/660, 439/924.1, 885
See application file for complete search history.

(56) References Cited

U.S. PATENT DOCUMENTS 3,711,819 A * 1/1973 Matthews ..... 439/682
4,034,172 A * 7/1977 Glover et al. ..... 200/51.1
4,483,575 A * 11/1984 Kruger et al. ..... 439/102
4,867,690 A * 9/1989 Thumma ..... 439/79
5,088,931 A * 2/1992 Niciolo et al. ..... 439/188
5,176,528 A * 1/1993 Fry et al. ..... 439/181
5,810,623 A * 9/1998 Regnier et al. ..... 439/637
6,036,549 A * 3/2000 Wulff ..... 439/660
6,254,978 B1 7/2001 Bahar et al.
6,435,910 B1 8/2002 Blasko et al.
6,468,091 B2 10/2002 Roussel et al.
6,478,586 B1 * 11/2002 Ma ..... 439/79
6,524,117 B1 * 2/2003 Murakami et al. ..... 439/74
6,547,586 B2 4/2003 Adduci
6,565,372 B2 5/2003 Bakker et al.
6,699,049 B1 * 3/2004 Wu ..... 439/79
6,739,889 B1 5/2004 Daggett et al.
6,846,191 B2 1/2005 Hobbs et al.
6,960,089 B2 * 11/2005 Lee et al. ..... 439/79

FOREIGN PATENT DOCUMENTS

JP 4-133280 * 5/1992 ..... 439/924.1

* cited by examiner

*Primary Examiner*—Tho D. Ta
(74) *Attorney, Agent, or Firm*—David P. Wood

(57) ABSTRACT

An electrical connection system comprises a female connector having a plurality of female terminals, and a male connector having a plurality of male blade terminals having projecting portions that plug into the plurality of female terminals respectively when the female connector and the male connector are mated. The male blade terminals are staggered having a first population with their tips at a first relative position and a second population with their at a second different relative position so that the first tips and the second tips do not touch and fully engage the mating female terminals and the plurality of male blade terminals at the same time thereby lowering the peak engagement force required for mating the female connector and the male connector. In an alternative arrangement, the female terminals, rather than the male blade terminals are staggered.

6 Claims, 4 Drawing Sheets

ELECTRICAL CONNECTION SYSTEM

BACKGROUND OF THE INVENTION

This invention relates generally to an electrical connection system, and more particularly to an electrical connection system having male and female connectors wherein the male connector has several male blade terminals that are plugged into mating female terminals of the female connector.

U.S. Pat. No. 6,435,910; U.S. Pat. No. 6,468,091; U.S. Pat. No. 6,546,586; U.S. Pat. No. 6,739,889 and U.S. Pat. No. 6,846,191 disclose typical examples of electrical connection systems, such as automotive electrical distribution centers, that have a male connector with a large number of male blade terminals that are plugged into mating female terminals of a female connector. These connection systems are designed with the tips of the male blade terminals all located at substantially the same height so that all of the male blade terminals touch the mating female terminals at substantially the same time. Consequently, considerable force, on the order of several hundred newtons, is required to plug the large number of male blade terminals into the mating female terminals for mating the electrical connectors and completing the electrical connection system Due to high engagement forces these electrical connection systems typically include an auxiliary mechanical device to assist in plugging the male blade terminals into the mating female terminals. For instance, the automotive electrical distribution centers disclosed in U.S. Pat. No. 6,435,910; U.S. Pat. No. 6,468,091; and U.S. Pat. No. 6,546,586 employ a fastener assembly that includes a bolt that is driven by an operator using a power tool for plugging the male connector fully into the female connector of the electrical connection system. On the other hand, the electrical connection systems disclosed in U.S. Pat. No. 6,739,889 and U.S. Pat. No. 6,846,191 employ a lever mechanism that adds considerable complexity and cost to the electrical connection system. In any event, these auxiliary mechanical devices increase manufacturing cost, add design complexity and increase the size of the electrical connection system in an environment where space may be at a premium.

SUMMARY OF THE INVENTION

The electrical connection system of the invention accommodates a male connector having a larger number of male blade terminals that are plugged into mating female terminals of a female connector while reducing the engagement force required to mate the connectors. This at least results in simplifying and/or reducing the cost, complexity and/or size of any mechanical auxiliary device that may be required to mate the connectors.

In some instances, the engagement force may be reduced enough so that the connectors may be mated without any need for any auxiliary mechanical device, for example, a fastener assembly or a lever mechanism, to assist in plugging the male connector into the female connector. In this second aspect, the electrical connection system of the invention accommodates a larger number of male blade terminals being plugged into mating female terminals simply by applying an unassisted manual, engagement force. To take full advantage of the invention, the connectors are preferably mated with a peak engagement force of about 75 newtons or less; 75 newtons being a practical ergonomic limit for an unassisted manual operation.

In its broadest aspect, the electrical connection system of the invention positions the tips of the male blade terminals and/or the tips of the mating female terminals at different locations in a staggered arrangement thereby dissipating the required engagement force over a wider range of motion and reducing the peak engagement force required to mate the male and female connectors. This staggered arrangement allows a higher number of male blade terminals and mating female terminals that can be included in each single electrical connection system that can be completed with a given engagement force.

In another aspect, the engagement force is reduced enough so that the single electrical connection system can be completed manually without any assistance from any auxiliary mechanical device.

DETAILED DESCRIPTION OF THE PREFERRED EMBODIMENTS

Figure 1:
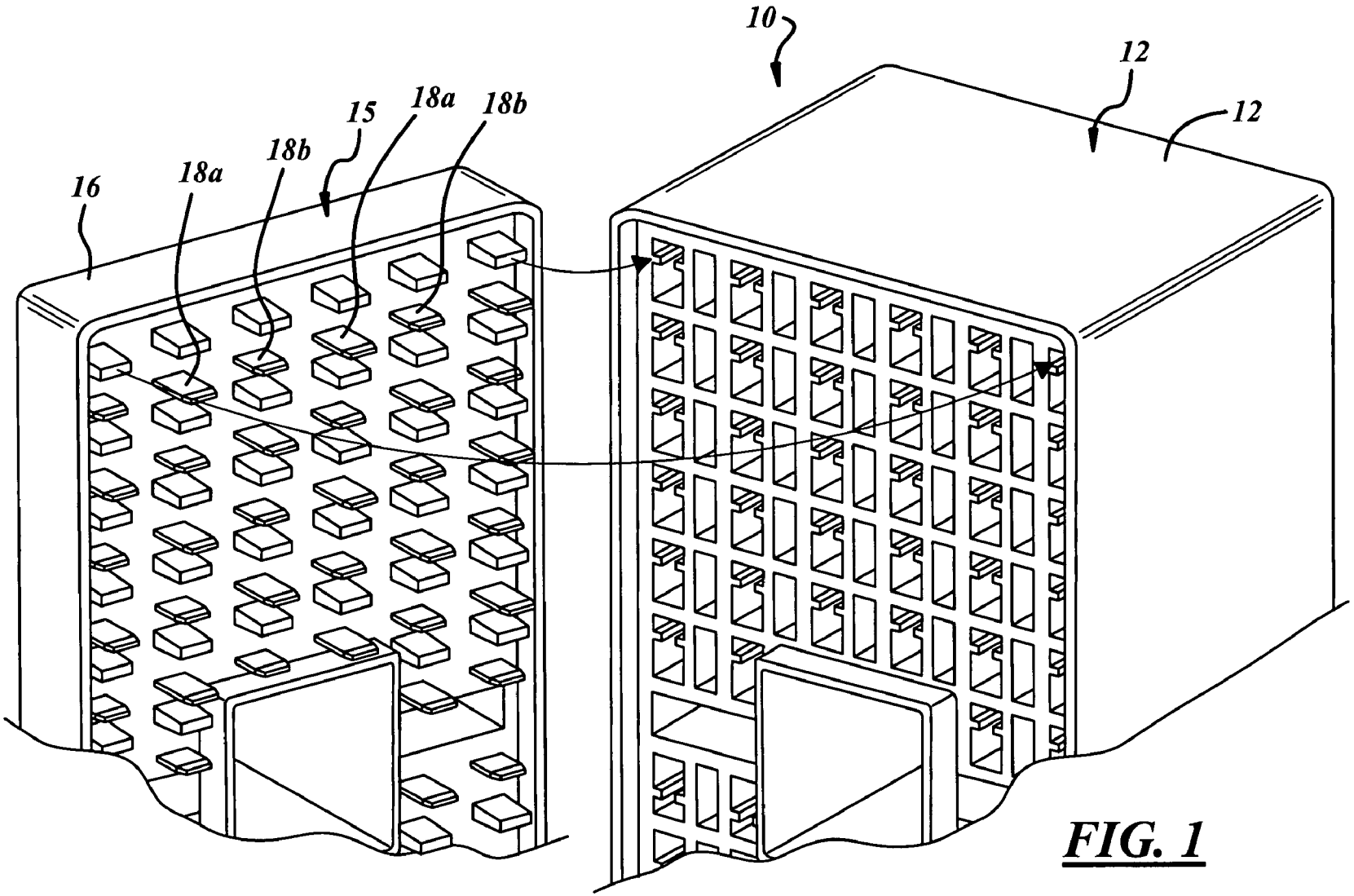
FIG. 1 is an exploded perspective view of a preferred embodiment of an electrical connection system of the invention.
Figure 2:
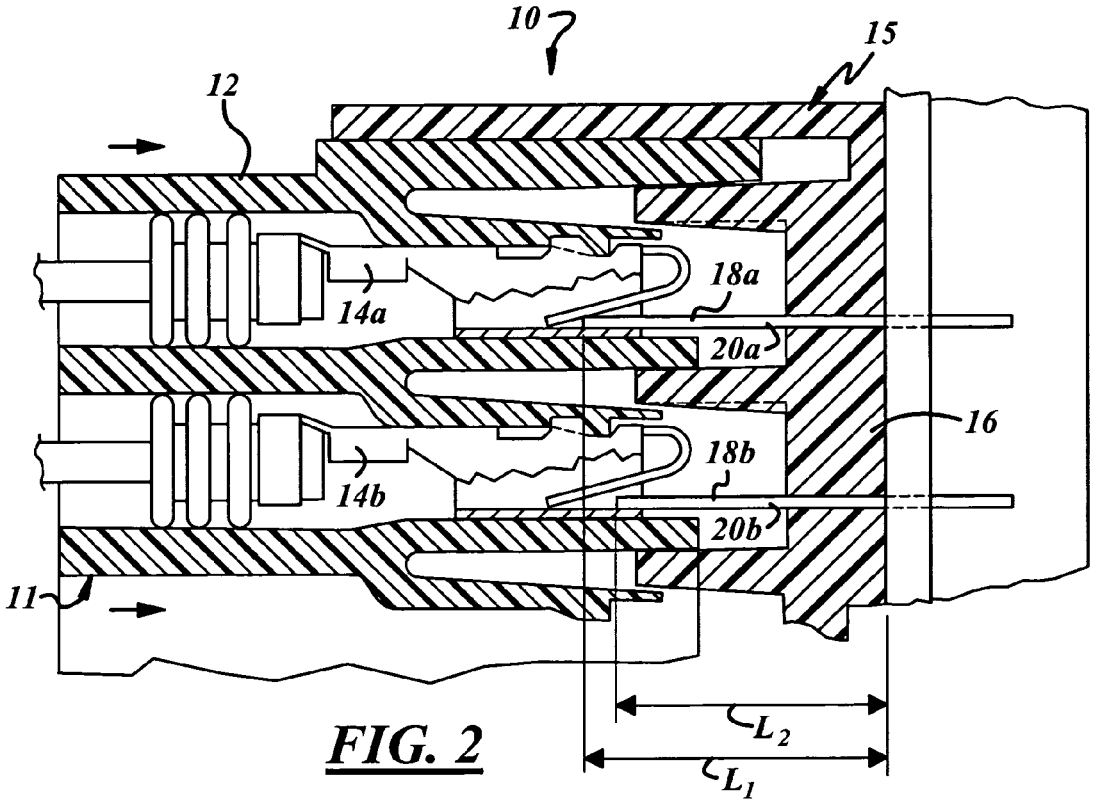
FIG. 2 is a partial cross section of the electrical connection system of FIG. 1 showing the male and female connectors partially mated.
Figure 4:
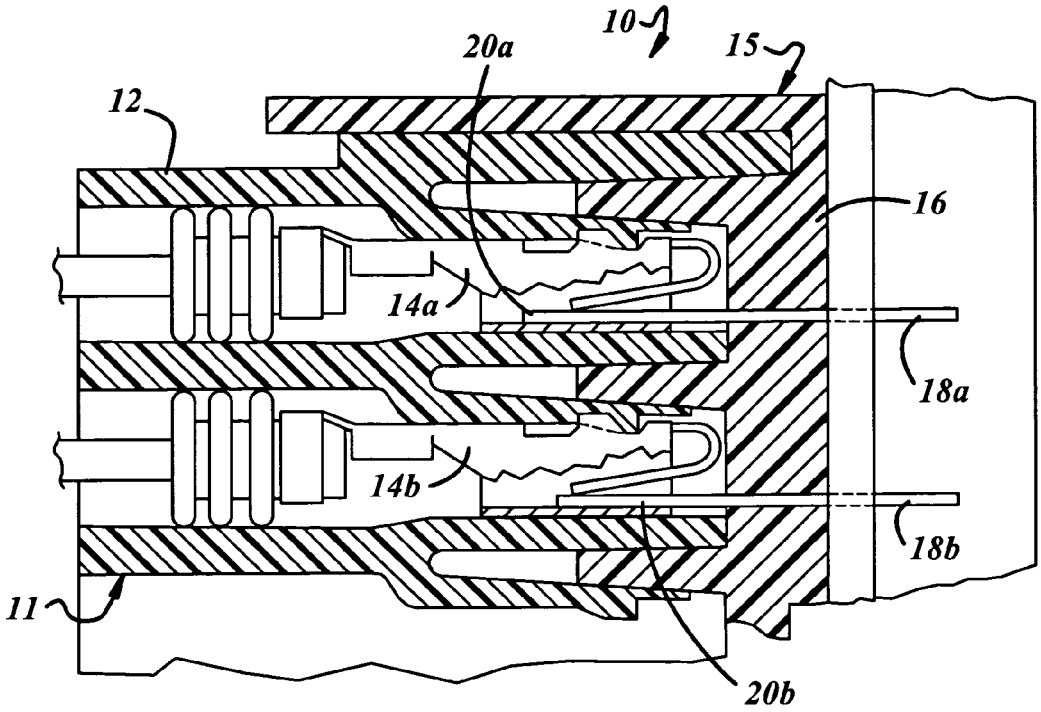
FIG. 4 is a fragmentary cross section of the electrical connection system of FIG. 1 showing the male and female connectors fully mated.

Referring now to FIGS. 1, 2 and 4 of the drawings, the electrical connection system 10 comprises a female connector 11 that includes a first connector body 12 having a plurality of female terminals 14*a* and 14*b*, and a male connector 15 that includes a second connector body 16 having a plurality of male blade terminals 18*a* and 18*b*. Male blade terminals 18*a* and 18*b* have projecting portions that plug into the plurality of the mating female terminals 14*a* and 14*b* respectively when the female connector 11 and the male connector 15 are moved toward each other in an engagement direction and mated.

Referring now to FIG. 2, the plurality of male blade terminals 18*a* and 18*b* comprises a first population of terminals 18*a* and a second population of terminals 18*b* that are attached to connector body 16. The projecting portions 20*a* of the first population of terminals 18*a* have a first projecting length $L_1$ in the engagement direction and tips at a first location with respect to connector body 16. The projecting portions 20*b* of the second population of terminals 18*b* have a second projecting length $L_2$ in the engagement direction that is different than the first projecting length $L_1$ and tips at a different location with respect to connector body 16. In this case, the projecting length $L_2$ of the second population of terminals 18*b* is less as shown in FIG. 2. Thus the first population of male blade terminals 18*a* have tips that touch a first mating set of female terminals 14*a* and start plugging into these female terminals before the tips of the second population of male blade terminals 18*b* touch and plug into a second mating set of female terminals 14*b*. Thus all the male blade terminals are not mated to the female terminals at the same time thereby lowering the peak engagement force necessary for completing for the electrical connection system 10.

The population of terminals 18*a* and 18*b* may be in any proportion to achieve improved results. However, the populations are preferably equal, that is, the male terminals of male connector 15 are preferably 50% male blade terminals 18*a* and 50% shorter male blade terminals 18*b* to maximize the peak engagement force reduction. Of course, this is not possible with an odd number of terminals in which case, the number of terminals in each of the two populations should be as equal as possible.

Figure 3:
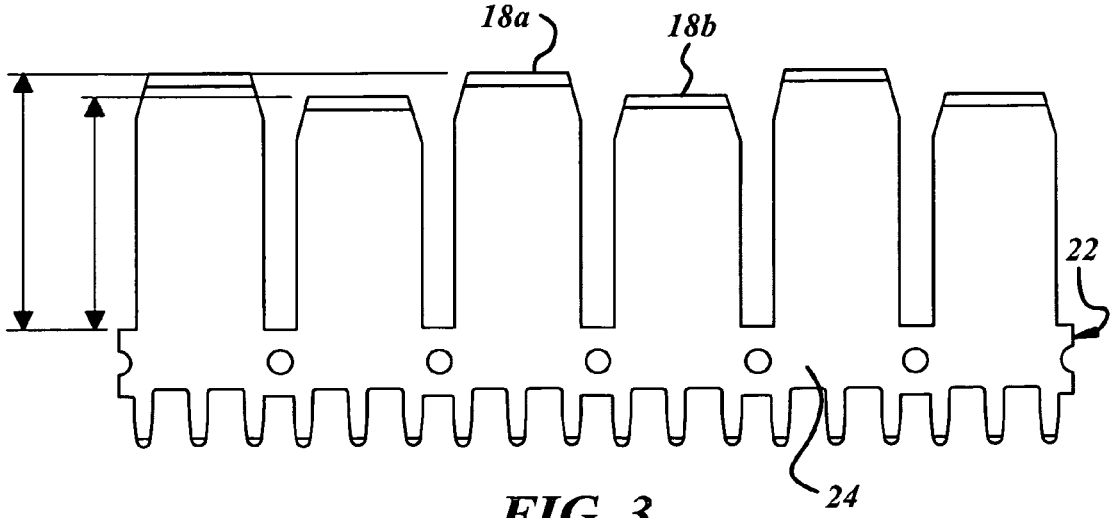
FIG. 3 is a front view of a strip of male blade terminals for use in the male connector of FIGS. 1 and 2.

FIG. 3 is a view of a portion of a reel 22 of male blade terminals that provides one possibility for fabricating the male connector 15. In this case, the position alternating height of the male terminals 18*a* and 18*b* in the male connector 15 is automatically controlled by fabricating the male terminals 18*a* and 18*b* in a pre-determined staggered pattern to reduce the peak engagement force. The automatic terminal positioning is controlled by the original terminal make die design which stamps two male blade terminals per die stroke and which is termed as a "2-out" die design. In the pair of male blade terminals that are stamped per die stroke, one terminal 18*a* of the pair will be tooled longer than the other terminal 18*b* of the pair. This alternating terminal body die detail is repeated through the remaining die stamping stations which then produces a continuous terminal reel 22 with terminals 18*a* and 18*b* alternately attached by a carrier strip 24. Terminals 18*a* and 18*b* are cut from carrier strip 24 and assembled to connector body 16 in a well known manner.

FIG. 4 shows the electrical connection system 10 fully mated with the typical male blade terminals 18*a* and 18*b* of varying heights plugged into the female terminals 14*a* and 14*b* which are all located in the same relative position in the connector body 12 of female connector 11.

Figure 5A:
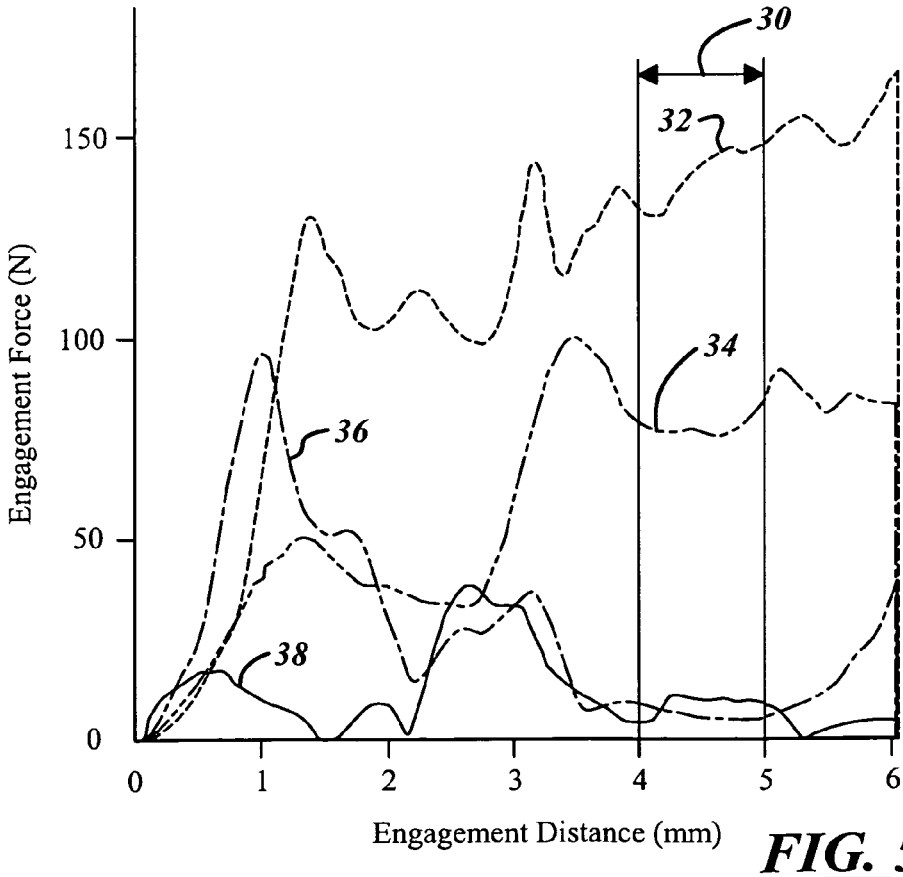
FIGS. 5*a* and 5*b* are engagement force graphs.
Figure 5B:
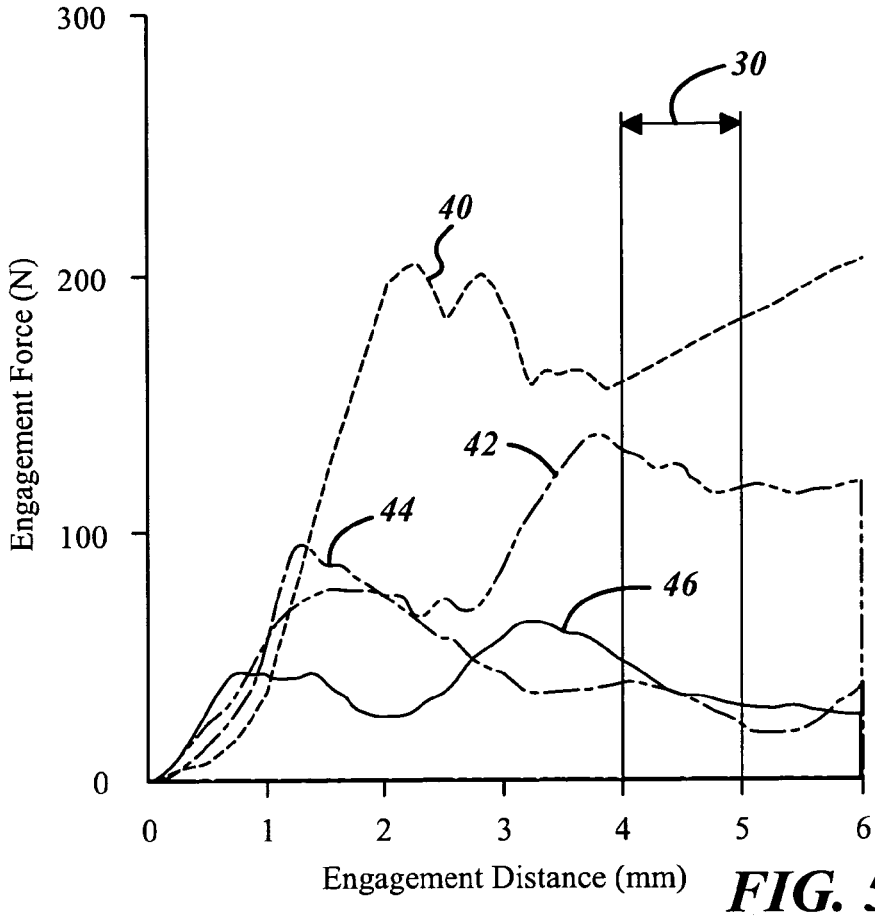

FIGS. 5*a* and 5*b* are graphs of the test results measuring the engagement force required to mate various electrical connection systems comprising male connectors having 28 and 48 male blade terminals and female connectors having a corresponding number of mating female terminals respectively. In each case, the engagement distance from the initial engagement or touch to an engagement of 6 mm is shown. The normal operating engagement in each case is from 4 mm to 5 mm as indicated at 30.

FIG. 5*a* are graphs of the test results for four 28 terminal test samples. In the first 28 terminal test sample, the male blade terminals had substantially the same height and the mating female terminals had substantially the same relative position in the female connector so that all the male blade terminals touched and plugged into the mating female terminals substantially simultaneously. The results which are plotted in the graph 32 in FIG. 5*a* show a peak engagement force of almost 150 newtons which occurs when the male blade terminals are plugged into the female terminals near the end of the operating engagement 30 at about 5 mm. Graphs 32 also shows earlier peaks at about 1.5 mm and 3.2 mm.

In the second 28 terminal test sample, the male blade terminals were staggered with a 50% population having their blade tips 2 mm ahead of the tips of the other 50% population. The results which are plotted in graph 34 show a peak engagement force of about 100 newtons which occurs just before the operating engagement 30 at about 3.5 mm. Thus graphs 32 and 34 show that staggering 50% of the terminal population results in approximately a 33% reduction of the required engagement force, that is, from about 150 newtons to about 100 newtons. Thus it can be seen that the staggering arrangement of the invention results in a reduced engagement force required for mating connectors having multiple terminals.

In a third 28 terminal test sample, the terminals were arranged in a conventional manner as in the case of the first 28 terminal test sample. However the male blades were coated with polytetrafluoroethylene (PTFE) according to the disclosure of U.S. Pat. No. 6,254,979 granted to George Drew et al. Jul. 3, 2001, which is incorporated herein by reference. The results which are plotted in graph 36 shows a peak engagement force of about 96 newtons at about 1 mm. Consequently it appears that the staggered terminal arrangement results in more or less the same advantage as the use of low friction electrical terminals, that is, a reduction in the required engagement force of about 33%.

In a fourth 28 terminal test sample, the male blade terminals were staggered with a 50% population having their blade tips 2 mm ahead of the tips of the other 50% population and also coated with PTFE. The results which are plotted in graph 38 show a peak engagement force of about 38 newtons which occurs at about 2.8 mm. Thus the combination of staggered and coated low friction terminals yields a surprising and unexpected result in a required engagement force reduction of about 74%.

In the first 48 terminal test sample, the male blade terminals again had substantially the same height and the mating female terminals had substantially the same relative position in the female connector so that all the male blade terminals touched and plugged into the mating female terminals substantially simultaneously. The results which are plotted in the graph 40 in FIG. 5*b* show a peak engagement force of about 205 newtons which occurs at about 2.3 mm when all the male blade terminals are being plugged into the female terminals.

In the second 48 terminal test sample, the male blade terminals were again staggered with a 50% population having their blade tips 2 mm ahead of the tips of the other 50% population. The results which are plotted in graph 42 show a peak engagement force of about 138 newtons which occurs just before the operating engagement 30. Thus graphs 32 and 34 also show staggering 50% of the terminal population results in approximately a 33% reduction of the required engagement force, that is, from about 205 newtons to about 138 newtons. Thus it appears that the staggering arrangement of the invention results in a reduced required engagement force that is more or less about the same for any number of terminals. In any event, it is clear that the staggered terminal arrangement allows a greater number of terminals in a connection system for a given required engagement force. Or stated another way, the required engagement force can be reduced for a given number of terminals by staggering the terminals.

In a third 48 terminal test sample, the terminals were arranged in a conventional manner as in the case of the first 48 terminal test sample. However the male blades were coated with polytetrafluoroethylene (PTFE) according to the disclosure of U.S. Pat. No. 6,254,979 granted to George Drew et al. Jul. 3, 2001. The results which are plotted in graph 46 shows a peak engagement force of about 95 newtons at about 1 mm which is a reduction of about 54%. While the staggered terminal arrangement results in more or less the same advantage regardless of the number of terminals, it appears that the use of low friction electrical terminals appears to have a larger advantage as the number of terminals increases.

In a fourth 48 terminal test sample, the male blade terminals were staggered with a 50% population having their blade tips 2 mm ahead of the tips of the other 50% population and also coated with PTFE. The results which are plotted in graph 46 show a peak engagement force of about 38 newtons which occurs at about 3.2 mm. Thus the combination of staggered, coated low friction terminals yields a surprising and unexpected result in a required engagement force reduction of about 81% even when the number of terminals are doubled.

Figure 6:
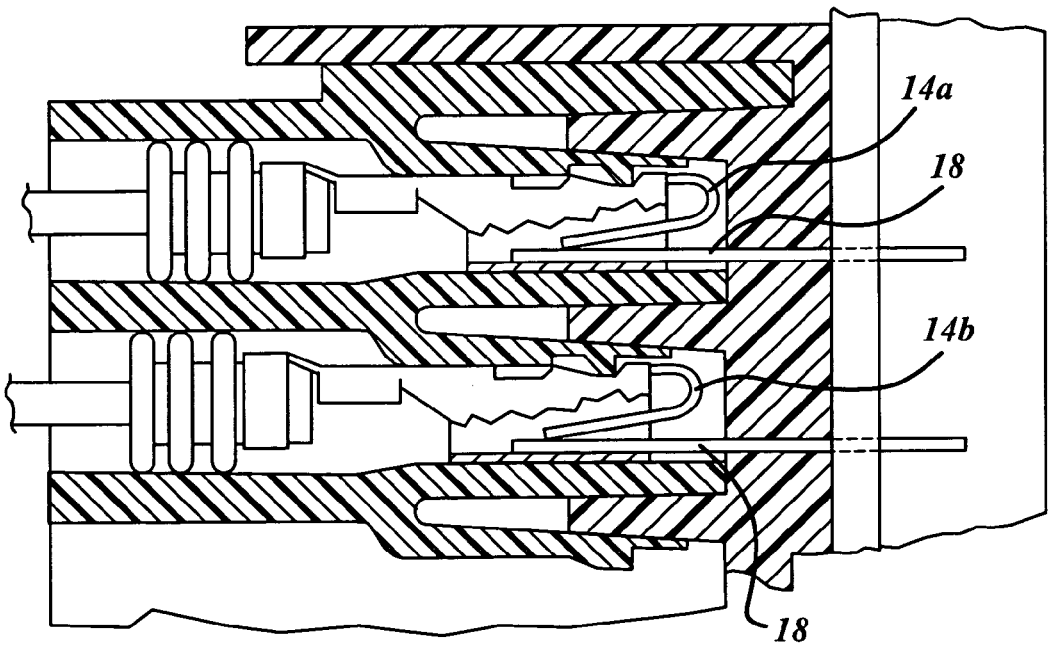
FIG. 6 is a partial cross section of another preferred embodiment of an electrical connection system of the invention.

FIG. 6 shows another embodiment of the invention where, the male blade terminals 18 all have the same height while the female terminals 14 are divided into a first population of female terminal 14*a* and a second population of female terminals 14*b* that are placed with their tips at different relative positions in the connector body 12 to lower the peak engagement force requirement. Of course, it is possible to do both, that is, to combine staggered populations of male blade terminals 18 with staggered populations of female terminals 14. Moreover, neither the male nor the female terminals need to be divided into two equal populations or even two populations, as it is possible to have three, four or even more staggered populations of terminals that differ in height in the case of male blade terminals or in relative position in the case of female terminals.

In other words, it will be readily understood by those persons skilled in the art that the present invention is susceptible of broad utility and application. Many embodiments and adaptations of the present invention other than those described above, as well as many variations, modifications and equivalent arrangements, will be apparent from or reasonably suggested by the present invention and the foregoing description, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the following claims and the equivalents thereof.

I claim:

1. An electrical connection system comprising:

a female connector having a plurality of female terminals, and a male connector having a plurality of male blade terminals having projecting portions that plug into the plurality of female terminals respectively when the female connector and the male connector are moved toward each other in an engagement direction and mated, one of the plurality of female terminals and the plurality of male blade terminals having a first population of terminals having first tips at a first relative position and a second population of terminals having second tips at a second relative position that is different than the first relative position so that the first tips and the second tips do not touch another of the plurality of female terminals and the plurality of male blade terminals at the same time thereby lowering a peak engagement force required for mating the female connector and the male connector, and wherein the first population of terminals and the second population of terminals have identical terminals.

2. The electrical connection system of claim 1 wherein the plurality of female terminals have the first population of terminals having first tips at the first relative position and the second population of terminals having second tips at the second relative position that is different than the first relative position so that the first tips and the second tips do not touch the plurality of male blade terminals at the same time.

3. The electrical connection system of claim 1 wherein the plurality of male blade terminals have the first population of terminals having first tips at the first relative position and the second population of terminals having second tips at the second relative position that is different than the first relative position so that the first tips and the second tips do not touch the plurality of female terminals at the same time.

4. The electrical connection system of claim 1 wherein the one of the plurality of female terminals and the plurality of male blade terminals having the first population of terminals having first tips at the first relative position fully engage a mating set of another of the plurality of female terminals and the plurality of male blade terminals before the second population of terminals having second tips at the second relative position fully engage a mating set of the another of the plurality of female terminals and the plurality of male blade terminals thereby lowering the peak engagement force required for mating the female connector and the male connector.

5. The electrical connection system as defined in claim 1 wherein the peak engagement force required for mating the female connector and the male connector is reduced at least about 33%.

6. An electrical connection system comprising:

a female connector having a plurality of female terminals, and a male connector having a plurality of male blade terminals having projecting portions that plug into the plurality of female terminals respectively when the female connector and the male connector are moved toward each other in an engagement direction and mated, one of the plurality of female terminals and the plurality of male blade terminals having a first population of terminals having first tips at a first relative position and a second population of terminals having second tips at a second relative position that is different than the first relative position so that the first tips and the second tips do not touch another of the plurality of female terminals and the plurality of male blade terminals at the same time thereby lowering a peak engagement force required for mating the female connector and the male connector, and wherein the peak engagement force required for mating the female connector and the male connector does not exceed about 75 newtons.

* * * * *